US006099099A

United States Patent [19]

Shufelt et al.

[11] Patent Number: 6,099,099

[45] Date of Patent: Aug. 8, 2000

[54] DRAWER SLIDE PROTECTOR

[75] Inventors: J. Ray Shufelt; Glen P. Keaton, both of High Point, N.C.

[73] Assignee: Top Supplies, Inc.

[21] Appl. No.: 09/073,589

[22] Filed: May 6, 1998

[51] Int. Cl.[7] ..... A47B 88/00

[52] U.S. Cl. ..... 312/334.1; 312/234; 312/330.1; 40/666

[58] Field of Search ..... 312/330.1, 234.1, 312/234, 334.1, 334.7, 334.8, 334.29, 334.31; 40/325, 666, 661.03

[56] References Cited

U.S. PATENT DOCUMENTS

| | | | |
|---|---|---|---|
| 916,939 | 3/1909 | Willard | 40/666 |
| 2,541,585 | 2/1951 | Jones | 40/325 |
| 2,972,201 | 2/1961 | Niedermayer | 40/666 |
| 4,821,437 | 4/1989 | Abramson et al. | 40/661.03 X |
| 4,883,332 | 11/1989 | Hadad | 312/330.1 |
| 4,982,519 | 1/1991 | Hans | 40/666 |
| 5,394,632 | 3/1995 | Gebka et al. . | |
| 5,441,182 | 8/1995 | Sullivan | 40/666 X |
| 5,511,331 | 4/1996 | Morosini | 40/666 X |
| 5,511,332 | 4/1996 | Sturkie et al. | 40/661.03 |
| 5,769,213 | 7/1998 | Chatterson | 40/666 X |
| 5,785,401 | 7/1998 | Bowyer et al. | 312/334.7 X |

FOREIGN PATENT DOCUMENTS

| | | | |
|---|---|---|---|
| 223 | of 1903 | United Kingdom | 40/666 |

*Primary Examiner*—Peter M. Cuomo
*Assistant Examiner*—Hanh V. Tran
*Attorney, Agent, or Firm*—Rhodes & Mason, PLLC

[57] ABSTRACT

A protective device for removably attaching to a drawer slide. The drawer slide protector includes a generally elongated "C-shaped" cover sized to extend substantially around a drawer slide for protecting the drawer slide from paint or other coating materials, the "C-shaped" cover including a face portion and arms located on each side of the face wherein the face portion extends across the surface of the drawer slide and the arms extend around the edges of the drawer slide to grasp and hold the cover, wherein the cover includes at least one pair of opposed fingers extending from a lower interior edge of each of the arms for grasping the drawer slide. In the preferred embodiment, a pull tab is attached to the face portion, the pull tab extending outwardly from the cover for removing the cover from the drawer slide.

31 Claims, 2 Drawing Sheets

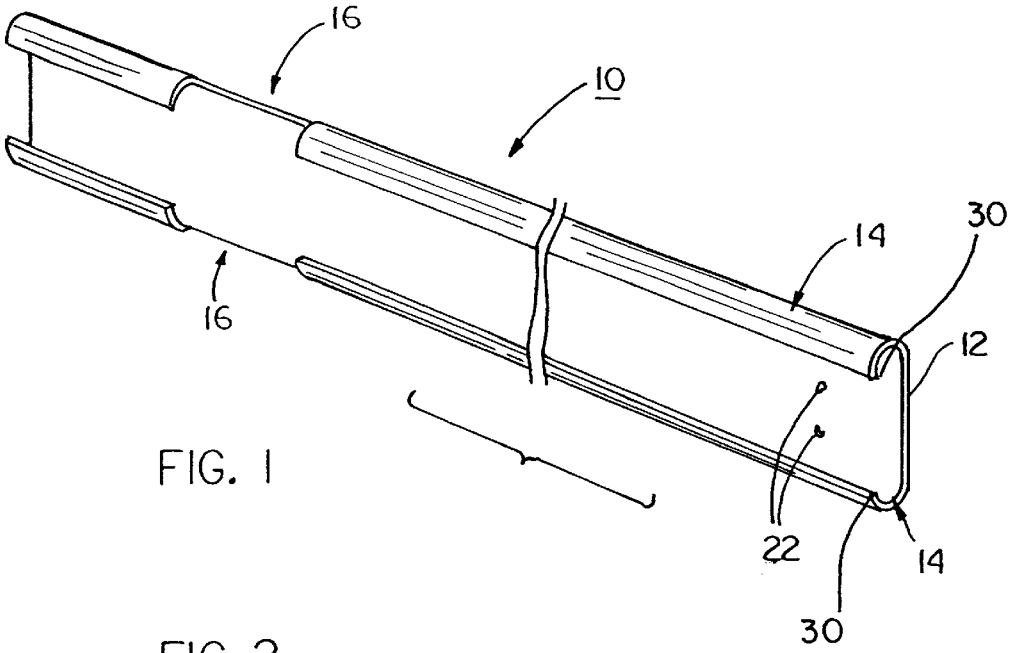
FIG. 1
FIG. 2
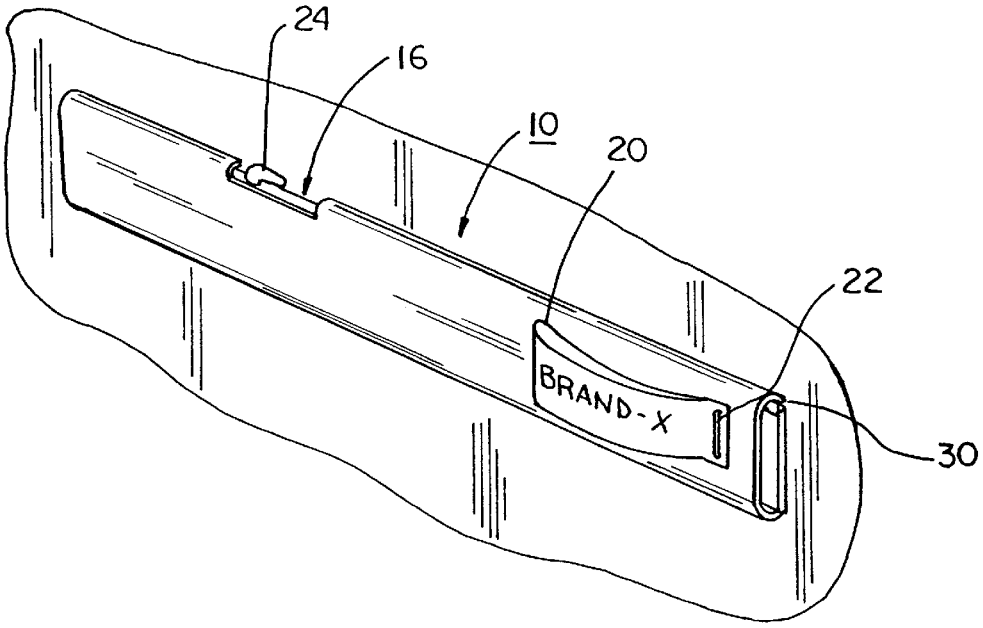

DRAWER SLIDE PROTECTOR

BACKGROUND OF THE INVENTION (1) Field of the Invention

The present invention relates generally to a device for protecting a drawer slide during manufacturing and finishing an article of furniture such as a desk or an entertainment center and, more particularly, a protector having a face and arms that surround the drawer slide which can be reusably fastened and removed from a drawer slide after the finishing operation over and over again.

(2) Description of the Prior Art

During the construction of a furniture piece, the various sections and components are built in a sequential manner that ultimately finishes with a completed piece that is then sold to a customer. One of the steps in this sequential process is placing drawer slides in the interior sections of furniture such as entertainment centers, desks, dressers, etc. The drawer slides are often placed in the furniture before completion of the furniture. As a result, the drawer slides may become damaged during the construction, particularly during the coating steps when the furniture is painted, stained, or otherwise finished. If the drawer slides become covered by the coating material, the coating will reduce the efficiency of the drawer slides making them more difficult to pull out, clogging the bearings of the slide, and even possibly preventing movement of the drawer slide altogether.

Previous attempts to protect the drawer slides during furniture manufacturing have had numerous drawbacks. One alternative was to use a plastic sheet wrap around the slide before installation. The wrap makes it difficult for the person installing the slide to handle and properly install the drawer slide when this wrap is placed on the drawer slide prior to its installation in the furniture. When placed on the drawer slide after installation, it is difficult for the fabric wrap to adhere and stay in place on the drawer slide. In either alternative, the wrap may be used only once which leads to waste and is more expensive and time consuming during installation.

Another alternative is to coat the drawer slide and bearings with a large amount of grease. The grease is effective in keeping the coating off the bearings, but results in grease getting on the user or other sections of the furniture which result in additional problems.

The most popular method used currently to protect the slide from dust, dirt and finishing is masking tape. The tape is generally placed over the slide in strips. However, tape removal is messy and often leaves an undesirable film on the slide.

Thus, there remains a need for a protective device for fastening over a mounted drawer slide during manufacturing that is inexpensive and easy to use while, at the same time, may be reused a number of times.

SUMMARY OF THE INVENTION

The present invention is directed to a protective device for removably attaching to a drawer slide. The drawer slide protector includes a generally elongated "C-shaped" cover sized to extend substantially around a drawer slide for protecting the drawer slide from paint or other coating materials.

In the preferred embodiment, the "C-shaped" cover including a face portion and arms located on each side of the face wherein the face portion extends across the surface of the drawer slide and the arms extend around the edges of the drawer slide to grasp and hold the cover, wherein the cover includes at least one pair of opposed fingers extending from a lower interior edge of each of the arms for grasping the drawer slide.

Also, in the preferred embodiment, a pull tab is attached to the face portion, the pull tab extends outward from the cover and is positioned in proximity to a first end of the "C-shaped" cover for removing the cover from the drawer slide. The pull tab may include surface indicia for identifying the source of the cover and may be constructed of a flexible, durable fabric or paper material.

Accordingly, one aspect of the present invention is to provide a protective member for removably attaching to a drawer slide, the drawer slide protector including a generally elongated "C-shaped" cover sized to extend substantially around a drawer slide for protecting the drawer slide from paint or other coating materials, the "C-shaped" cover including a face portion and arms located on each side of the face wherein the face portion extends across the surface of the drawer slide and the arms extend around the edges of the drawer slide to grasp and hold the cover.

Another aspect of the present invention is to provide a protective member for removably attaching to a drawer slide, the drawer slide protector including a generally elongated "C-shaped" cover sized to extend substantially around a drawer slide for protecting the drawer slide from paint or other coating materials, the "C-shaped" cover including a face portion and arms located on each side of the face wherein the face portion extends across the surface of the drawer slide and the arms extend around the edges of the drawer slide to grasp and hold the cover, wherein the cover includes at least one pair of opposed fingers extending from a lower interior edge of each of the arms for grasping the drawer slide.

Still another aspect of the present invention is to provide a protective member for removably attaching to a drawer slide, the drawer slide protector including a generally elongated "C-shaped" cover sized to extend substantially around a drawer slide for protecting the drawer slide from paint or other coating materials, the "C-shaped" cover including a face portion and arms located on each side of the face wherein the face portion extends across the surface of the drawer slide and the arms extend around the edges of the drawer slide to grasp and hold the cover, wherein the cover includes at least one pair of opposed fingers extending from a lower interior edge of each of the arms for grasping the drawer slide; and a pull tab attached to the face portion, the pull tab extending outwardly from the cover for removing the cover from the drawer slide.

These and other aspects of the present invention will become apparent to those skilled in the art after a reading of the following description of the preferred embodiment when considered with the drawings.

BRIEF DESCRIPTION OF THE DRAWINGS

FIG. 1 is a side elevational view of a drawer slide protector constructed according to the present invention;

FIG. 2 is a perspective view of the drawer slide cover mounted on a drawer slide and having a pull tab for easy removal;

DESCRIPTION OF THE PREFERRED EMBODIMENTS

Figure 3A:
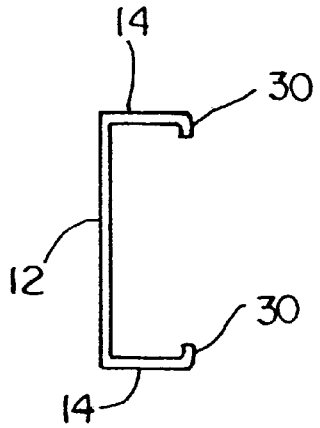
FIG. 3A is a cross-sectional view of the preferred embodiment of the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a drawer slide protector, generally designated 10, is shown constructed according to the present invention. The drawer slide protector is generally elongated having a face 12 and arms 14 extending from the sides of the face. Notches 16 may be placed along the length of the protector to align with protuberances extending from the drawer slide.

The slide protector 10 is preferably constructed of one single piece of extruded or injection molded material. The material should be flexible and resilient to facilitate the mounting and removal of the protector from a drawer slide and allow the arms 14 to be bent outward away from the center of the face and return back to the original orientation. The slide protector should also be constructed of a durable material to be reused any number of times and does not break down or otherwise react with the coatings placed upon or inside the furniture. In one preferred embodiment, the protective cover is constructed of a thermoplastic such as polyvinyl chloride (PVC).

Figure 3B:
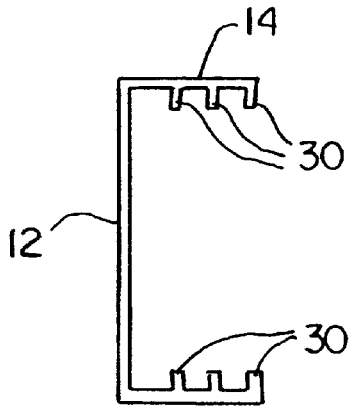
FIG. 3B is a cross-sectional view of the preferred embodiment of the invention further including a number of fingers extending from each arm to improve adhesion to the slide.
Figure 4:
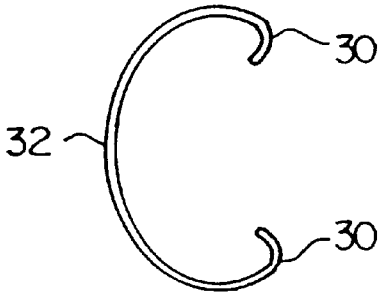
FIG. 4 is a cross-sectional view of an alternative embodiment of the present invention.

The face 12 of the protector is sized to extend over the width of the drawer slide. In one embodiment shown in FIGS. 3A, 3B and 5, the face 12 is substantially flat. Alternative embodiments include a substantially curved face and arm section that extends over the drawer slide as illustrated in FIG. 4. It will be understood that this invention contemplates any number of alternatives of dimensions that extend over the drawer slide since the width and length of the slide will vary according to slide manufacturer and particular models.

Figure 5:
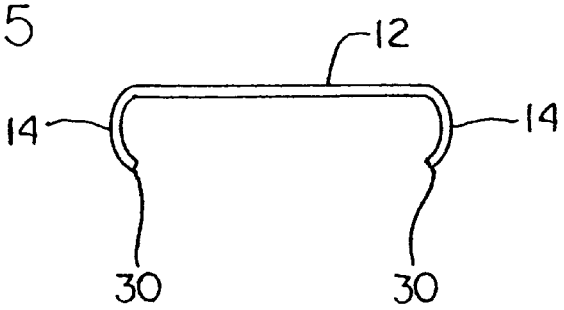
FIG. 5 is a cross-sectional view of an alternative embodiment of the present invention.

The arms 14 extend along the edges of the drawer slide. Various arrangements of the arms in relation to the face are including in the present invention. Embodiments include the arms extending at about 90° from the face as shown in FIGS. 3A and 3B, the arms and face being a continuous curve about the drawer slide as shown in FIG. 4, and the arms being curved as shown in FIG. 5. Fingers 30 extend from the inside edge of the arms 14 to hold the slide protector in position on the drawer slide.

Fingers 30 are located on the interior sides of the arms to grasp the drawer slide. In one embodiment illustrated in FIGS. 3A and 4, a single finger extends from the lower edge of each arm to extend around the back edge of the drawer slide and hold the protective cover in position. Each of the arms may include a number of fingers that extend inward to assist in grasping the drawer slide such as the embodiment illustrated in FIG. 3B. The fingers 30 can extend at an angle from the drawer slide, or may also extend substantially straight depending on the specific embodiments.

Notches 16 are placed along the length of the slide protector and align with catches or protuberances 24 extending outwardly from the drawer slide. The notches 16 are preferably sized to snugly fit about the protuberances 24 to minimize the open space in which coatings can contact the drawer slide. Preferably, the notches are evenly spaced on each of the arms 14 as shown in FIG. 1 which allows for the slide protectors to be attached to either a right handed or left handed drawer slide by simply rotating the slide protector 180°.

In operation, the slide protector shown in FIG. 1 can be installed on a drawer slide that is mounted on the left hand side of a piece of furniture. Because of its symmetry, the slide protector can be rotated 180° to be placed on the drawer slide on the right hand edge of the piece of furniture. This arrangement provides for the protector to be used in a wider variety of situations. It is also understood that any number of notches 16 can be placed along either one of the arms 14 depending on the design of the particular slide.

In the preferred embodiment, a pull tab 20 attaches to the face 12 of the slide protector to provide for a user to remove the slide protector from the drawer slide. The pull tab 20 is preferably a durable fabric or paper, such as TYVEK®, which may be used a number of times. The pull tab 20 can also be used for surface indicia such as advertising or other. A connector 22 attaches the pull tab to the drawer slide in a fixed manner such a staple, glue, rivet or other fastening mechanism.

Certain modifications and improvements will occur to those skilled in the art upon a reading of the foregoing description. By way of example, the notches and pull tap could be injection molded at the same time the cover is formed. Also, the slide cover could be made "oversized" to permit it to fit over the slide protrusions without being notched. It should be understood that all such modifications and improvements have been deleted herein for the sake of conciseness and readability but are properly within the scope of the following claims.

We claim:

1. A drawer slide protector removably attaches to a drawer slide, said drawer slide protector comprising: a generally elongated "C-shaped" cover sized to extend substantially around a drawer slide for protecting said drawer slide from paint or other coating materials, said "C-shaped" cover including a face portion and arms located on each side of said face portion, said face portion extending across the surface of the drawer slide and said arms extending around the edges of the drawer slide, said "C-shaped" cover further including a pull tab permanently attached to said face portion and extending outwardly from said "C-shaped" cover.

2. The apparatus according to claim 1, wherein said pull tab is positioned in proximity to a first end of said "C-shaped" cover for removing said cover from the drawer slide.

3. The apparatus according to claim 1, wherein said pull tab is attached to said face portion by at least one connector.

4. The apparatus according to claim 3, wherein said connector is a self-joining fastener.

5. The apparatus according to claim 4, wherein said self-joining fastener is a staple.

6. The apparatus according to claim 1, wherein said pull tab includes surface indicia for identifying the source of said cover.

7. The apparatus according to claim 1, wherein said pull tab is constructed of a durable fabric or paper material.

8. A protective member removably attaches to a drawer slide, said protective member comprising: a generally elongated "C-shaped" cover sized for extending substantially around a drawer slide for protecting said drawer slide from paint or other coating materials, said "C-shaped" cover including a face portion extending across the surface of the drawer slide and arms located on each side of said face for extending around the edges of the drawer slide for grasping and holding said cover, wherein said cover includes at least one pair of opposed fingers extending from a lower interior edge of each of said arms for grasping the drawer slide and each of said arms include a notch cut.

9. The apparatus according to claim 8, wherein said cover includes at least two fingers extending from each of said arms.

10. The apparatus according to claim 8, wherein said notches are positioned the same distance from a first end of said drawer slide.

11. The apparatus according to claim 8, wherein said "C-shaped" cover is constructed of a resilient material for flexing and bending around the drawer slide.

12. The apparatus according to claim 11, wherein said "C-shaped" cover is constructed of plastic.

13. The apparatus according to claim 8, wherein said "C-shaped" cover length is substantially greater than its width.

14. The apparatus according to claim 8, wherein said face portion is substantially straight.

15. The apparatus according to claim 14, wherein said arms extend from said face portion at about 90 degrees.

16. The apparatus according to claim 8, wherein said face portion is substantially curved.

17. A protective member removably attaches to a drawer slide, said protective member comprising:

(a) a generally elongated "C-shaped" cover for extending substantially around a drawer slide for protecting said drawer slide from paint or other coating materials, said "C-shaped" cover including a face portion and arms located on each side of said faces said face portion extending across the surface of the drawer slide and said arms extending around the edges of the drawer slide to grasp and hold said cover, wherein said cover includes at least one pair of opposed fingers extending from a lower interior edge of each of said arms for grasping the drawer slide; and (b) a pull tab attached to said face portion, said pull tab extending outwardly from said "C-shaped" cover for removing said cover from said drawer slide.

18. The apparatus according to claim 17, wherein said pull tab is positioned in proximity to a first end of said "C-shaped" cover for removing said cover from the drawer slide.

19. The apparatus according to claim 17, wherein said pull tab is attached to said face portion by at least one connector.

20. The apparatus according to claim 19, wherein said connector is a self-joining fastener.

21. The apparatus according to claim 20, wherein said self-joining fastener is a staple.

22. The apparatus according to claim 17, wherein said pull tab includes surface indicia for identifying the source of said cover.

23. The apparatus according to claim 17, wherein said pull tab is constructed of a durable fabric or paper material.

24. The apparatus according to claim 17, wherein each of said arms include a notch cut out for extending about a protuberance extending from the drawer slide.

25. The apparatus according to claim 24, wherein said notches are positioned the same distance from a first end of said drawer slide.

26. The apparatus according to claim 17, wherein said "C-shaped" cover is constructed of a resilient material for flexing and bending around the drawer slide.

27. The apparatus according to claim 26, wherein said "C-shaped" cover is constructed of plastic.

28. The apparatus according to claim 17, wherein said "C-shaped" cover length is substantially greater than its width.

29. The apparatus according to claim 17, wherein said face portion is substantially straight.

30. The apparatus according to claim 29, wherein said arms extend from said face portion at about 90 degrees.

31. The apparatus according to claim 17, wherein said face portion is substantially curved.

* * * * *

UNITED STATES PATENT AND TRADEMARK OFFICE

CERTIFICATE OF CORRECTION

PATENT NO : 6,099,099

DATED : August 8, 2000

INVENTOR(S) : J. Ray Shufelt et al.

It is certified that error appears in the above-identified patent and that said Letters Patent are hereby corrected as shown below:

In Claim 17, line 7, after the first occurrance of said, "faces" should be --face,--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*